United States Patent [19]

Lee

[11] Patent Number: 4,812,789

[45] Date of Patent: Mar. 14, 1989

[54] RIDGED WAVEGUIDE WIDE BAND DIPLEXER WITH EXTREMELY SHARP CUT-OFF PROPERTIES

[75] Inventor: Kuan M. Lee, Brea, Calif.

[73] Assignee: Hughes Aircraft Company, Los Angeles, Calif.

[21] Appl. No.: 146,018

[22] Filed: Jan. 20, 1988

Related U.S. Application Data

[63] Continuation-in-part of Ser. No. 107,000, Oct. 5, 1987, abandoned, which is a continuation of Ser. No. 811,597, Dec. 19, 1985, abandoned.

[51] Int. Cl.[4] ..... H01P 1/213; H01P 1/209; H01P 1/207; H01P 1/18

[52] U.S. Cl. ..... 333/135; 333/159; 333/208; 333/209; 333/248; 370/30

[58] Field of Search ..... 333/202, 208–212, 333/157, 156, 159, 110, 126, 132, 134, 135, 34, 35, 245, 248, 227, 232, 33; 370/30, 37, 38, 112, 123, 69.1; 455/81, 82, 109, 129, 293; 343/756

[56] References Cited

U.S. PATENT DOCUMENTS 3,235,821 2/1966 Wilkinson ..... 333/159

4,060,778 11/1977 Hefni et al. ..... 333/34 X

FOREIGN PATENT DOCUMENTS 729405 5/1955 United Kingdom ..... 333/209

*Primary Examiner*—Marvin L. Nussbaum

*Attorney, Agent, or Firm*—Thomas A. Runk; Anthony W. Karambelas

[57] ABSTRACT

A wideband balanced diplexer splits an incoming wideband microwave frequency signal into separate upper and lower frequency outputs and possesses a sharp band cut-off to increase effective bandwidth. The diplexer includes a pair of waveguide assemblies for separating the upper frequency band from the incoming signal. Each waveguide assembly includes a tuneable, ridged waveguide phase shifter for shifting the phase of the lower frequency band, a reference waveguide for inserting a delay onto the upper frequency signal in order to compensate for the effects of the phase shifter in the other waveguide assembly, and a high pass filter. The high pass filter includes a ridged waveguide having tapered ends of a shape comprising an exponential function raised to a cosine squared power to increase the bandwidth of the upper frequencies and to provide a sharper frequency cut-off.

26 Claims, 2 Drawing Sheets

RIDGED WAVEGUIDE WIDE BAND DIPLEXER WITH EXTREMELY SHARP CUT-OFF PROPERTIES

This is a continuation-in-part of application Ser. No. 107,000 filed Oct. 5, 1987 now abandoned, which was a continuation of application Ser. No. 811,597 filed Dec. 19, 1985 now abandoned.

TECHNICAL FIELD

The present invention broadly relates to radio frequency devices for splitting signals into different frequency bands, and deals more particularly with a diplexer of the balanced type for use in the microwave frequency range which has a wide operating bandwidth (e.g. 8–18 GHz) and exceptionally sharp cut-off properties.

BACKGROUND ART

Diplexers are commonly used to split an incoming signal into two component parts, respectively having differing frequency components. The frequency splitting properties of diplexers are often used in the communications field, and particularly in radars to switch between two different operating frequencies.

Previously used diplexers operating in the microwave frequency range possessed a relatively narrow bandwidth (e.g. 8–12 GHz) and were therefore unsuitable for use in applications where is was necessary to cover a relatively wide bandwidth, e.g. 8–18 GHz. Consequently, in the past, in order to split an incoming wideband microwave signal into upper and lower components, it was necessary to use a switch in order to switch between the upper and lower frequency bands. The bandwidth restrictions for previous diplexers is a result of the inherent limitations of the ordinary waveguides used in such diplexers. So-called "ridged" waveguides and tapered waveguides have been used in the past in microwave frequency applications, but never have been combined for use in a balanced diplexer to increase bandwidth and achieve a sharp frequency cut-off.

SUMMARY OF THE INVENTION

According to the present invention, a wideband balanced type diplexer is provided for splitting an incoming wideband microwave frequency signal (e.g. 8–18 GHz) into an upper frequency band and a lower frequency band, which are respectively output as separate signals; the provision of separate upper (e.g. 12–18 GHz) and lower frequency (e.g. 8–18 GHz) band signals simultaneously, obviates the need for employing a switch or the like to switch between the upper and lower frequencies. A signal divider splits the incoming signal into a low frequency output and an intermediate signal which possesses both the upper and lower frequency components of the incoming signal. The divider also splits the intermediate signal into two identical signals of equal energy which are then respectively processed through two waveguide assemblies or branches which have identical components. Each waveguide assembly includes a tuneable, ridged waveguide phase shifter for shifting the phase of the lower frequency band, a reference waveguide for inserting a delay or normal phase shift into the upper frequency signal so as to compensate for the phase shift introduced by the other branch, and a high pass filter which passes the higher frequencies and reflects the phase shifted, lower frequencies. The high pass filter includes a ridged waveguide having tapered sidewalls so as to result in a low reflection loss in the passband and a very steep cut-off near the dividing frequency between the upper and lower frequency bands. The taper is in the shape of an exponential function raised to a cosine squared power. The phase shifter includes a double-ridged waveguide having a longitudinal array of tuning elements which are spaced apart at approximately a quarter wavelength at the center frequency. The reflection coefficients of the waveguides are set equal to optimal distributions for best match. The total transmission phase shift is adjusted to be 90 degrees at the lower frequency band. The wideband properties of the ridged waveguides and the special filters allow separating two frequency bands in a large bandwidth with an extremely sharp cut-off between the two bands. The transition frequency range is only 2% of the total bandwidth. The sharp frequency cut-off of the diplexer results in a larger useful frequency range with lower loss. Moreover, the use of waveguides allows the diplexer to be used in high power applications, such as radars.

DESCRIPTION OF THE PREFERRED EMBODIMENTS

Figure 1:
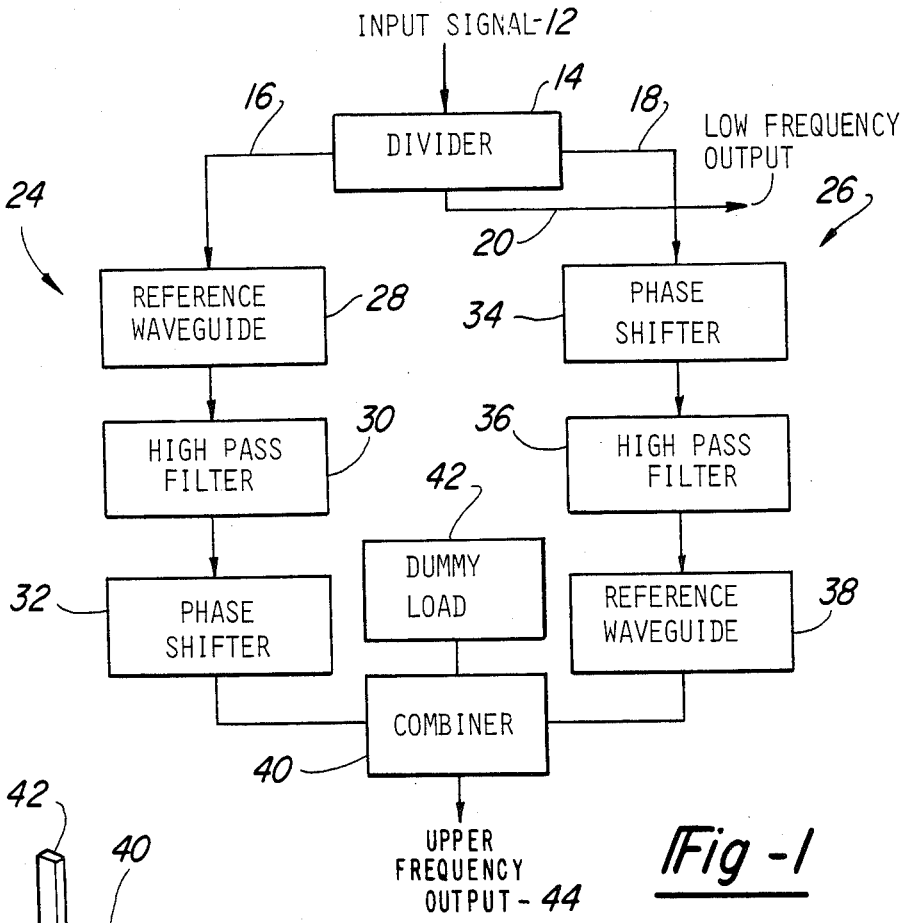
FIG. 1 is a broad block diagram of a wideband diplexer which forms the preferred embodiment of the present invention.
Figure 2:
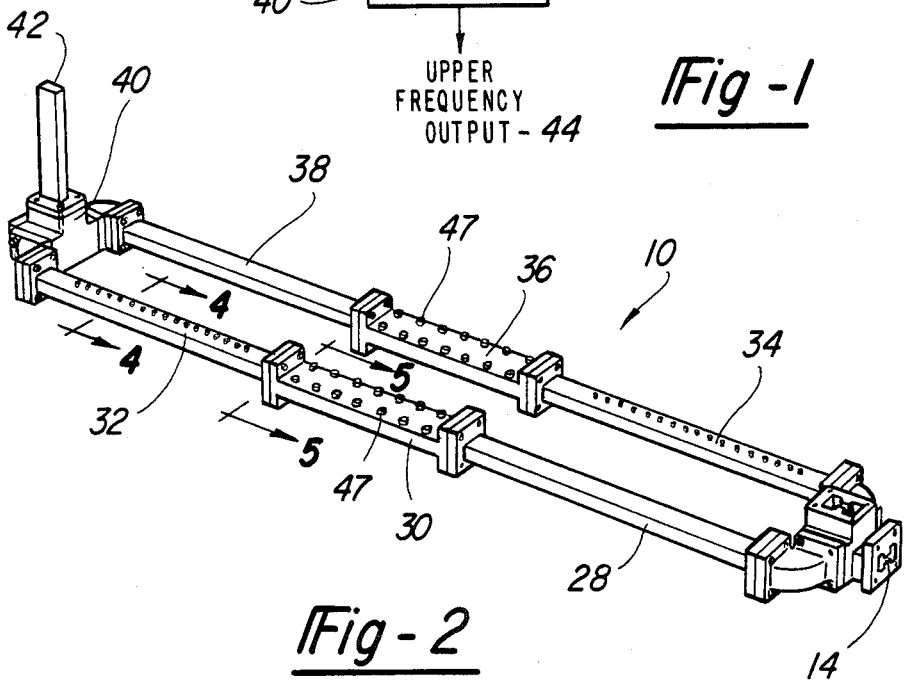
FIG. 2 is a perspective view of the wideband diplexer shown in FIG. 1.

Referring first to FIGS. 1 and 2, the present invention relates to a wideband diplexer, generally indicated by the numeral 10 for use in relatively high power (e.g. 50 KW–100 KW peak power) radio frequency communication systems, such as radars, in which it is desired to split or divide an incoming, relatively broadband microwave signal into two separate output signals respectively of upper and lower frequency bands. The incoming or input signal 12 may, for example be a microwave signal having a bandwidth of 8–18 GHz. The input signal 12 is delivered to the "sum" input of a signal divider 14. The signal divider 14 may be a commercially available device commonly referred to in the industry as a "magic-T" which is available from Microwave Research Company, 1429 Osgood Street, North Andover, Mass., 01845, and identified by the manufacturer's model no. R100-119. The input signal 12 with, for example, a frequency range from 8 to 18 GHz, is delivered to the "sum" port of the divider 14. The divider 14 includes a "difference" port indicated by the line 20 which is normally employed as an input and functions to cause the output signals at ports 16 and 18 to have a 180 degree phase difference. However, in the present invention, this difference port is employed as a low frequency output, and outputs a low frequency signal 22 which possesses only the low frequency band, e.g. 8–12 GHz, portion of the input signal 12. The input signal 12 is split by the divider 14 into two outputs on lines 16, 18;

these latter-mentioned "intermediate" output signals are identical in bandwith to the input signal 12 but each possesses approximately one-half the energy of the input signal 12.

The signals on lines 16 and 18 are respectively delivered through two branches or waveguide assemblies 24, 26 for separate processing. The waveguide assembly 26 comprises a phase shifter 34, a high pass filter 36 and a reference waveguide 38. The phase shifter 34 functions to shift the phase of the lower frequencies, e.g. 8–12 GHz, and introduces an arbitrary phase for the upper frequency band, e.g. 12–18 GHz, which is proportional to the path length of the filter 34. The signal delivered from the phase shifter 34 to the high pass filter 36 has the lower frequency band thereof shifted 90 degrees in phase relative to the signal delivered from the reference waveguide 28 to the high pass filter 30. The phase shifted, lower frequency band is reflected from the high pass filter 36 and therefore undergoes a second 90 degree phase shift so that the reflected signal is shifted a total of 180 degrees relative to the signal reflected back from the high pass filter 30. The high frequencies are passed through the filter 36 and the filter 30 to a reference waveguide 38 and a phase shifter 32 respectively.

The reference waveguide 38 is also avilable from Microwave Research as Model No. R10-9.45 and compensates for the phase shift introduced into the high frequencies by waveguide 28 and the phase shifter 34 compensates for the phase shift introduced by phase shifter 32 so that the signal output by the waveguide assembly 26 is balanced with that of the signal output from the waveguide assembly 24. The signal output from the reference waveguide 38 having only the upper passband frequencies is delivered to one input arm of a later-discussed signal combiner 40 where it is combined with the signal processed by the waveguide assembly 24.

The signal on line 16 is delivered to a reference waveguide 28 which is identical to reference waveguide 38 and functions to introduce the normal insertion phase into the incoming signal. The output of the reference waveguide 28 is passed through a high pass filter 30 which rejects the lower frequency band and passes the upper frequency band. The construction and function of the high pass filter 30 are identical to that of the high pass filter 36. The output signal from the high pass filter 30 is delivered through a phase shifter 32 which functions in a manner identical to that of phase shifter 34. The signal output from the phase shifter 32 is identical to that output from the waveguide 38, and these signals are combined by the signal combiner 40. The signal combiner 40 is also a commercially available, popularly known in the industry as a "magic-T" which is identical in construction to the signal divider 14 described above. The signals input to the combiner 14 from the waveguide assemblies 24, 26 each possess only the upper frequency band, e.g. 12–18 GHz, and possess equal energy and the same phase. The difference port of the signal combiner 40 is connected with a dummy load 42 which functions to absorb any unbalanced power in the event that the input signals to the combiner 40 are not equal, due to losses, etc. The input signals to the combiner 40 are combined and delivered as an upper frequency output signal 44 on the sum port of the combiner 40.

Figure 3:
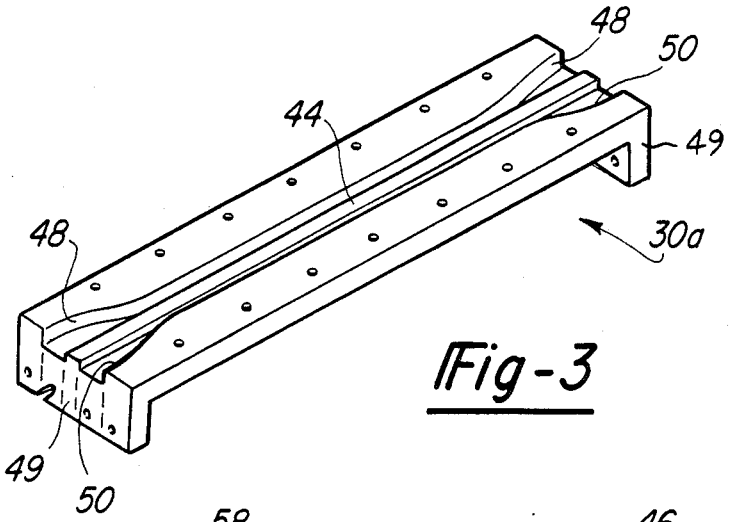
FIG. 3 is a perspective view of one-half of the high pass filter.
Figure 4:
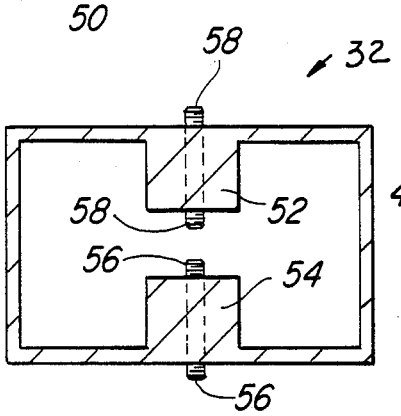
FIG. 4 is a sectional view taken along the line 4—4 in FIG. 2.
Figure 5:
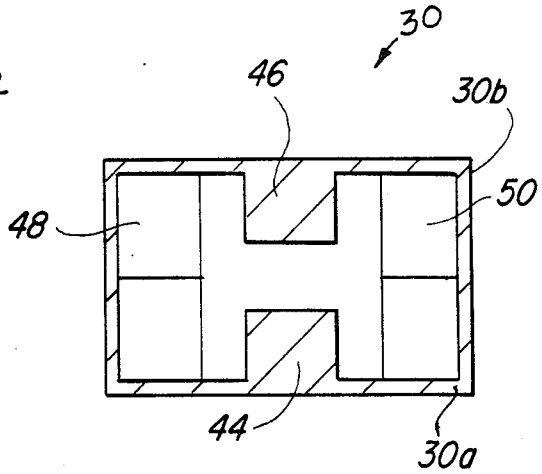
FIG. 5 is a sectional view taken along the line 5—5 in FIG. 2.
Figure 6:
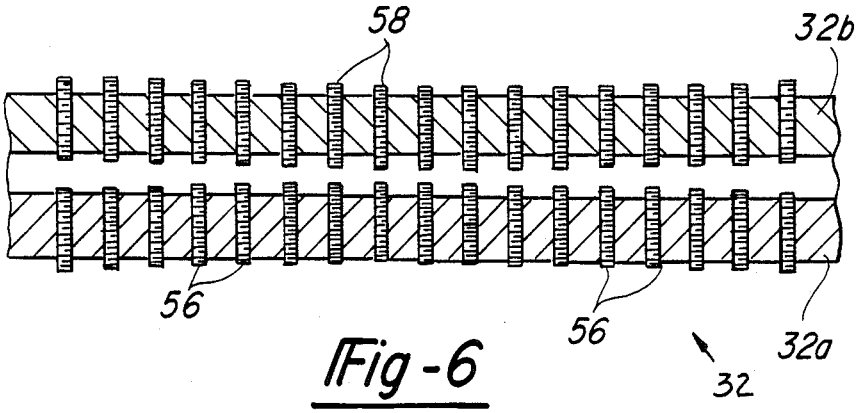
FIG. 6 is a longitudinal, sectional view of one of the phase shifters.

Attention is now also directed to FIGS. 3–6 wherein the details of the phase shifter 32 and the high pass filter are depicted in more detail. It is to be understood that phase shifter 34 and high pass filter 36 are respectively identical in construction details to phase shifter 32 and filter 30. As best seen in FIGS. 2, 4 and 6, the phase shifter 32 includes an elongate tubular, metal waveguide body defining a waveguide cavity. The waveguide cavity of the phase shifter 32 is substantially H-shaped in cross-section by virtue of a pair of longitudinal, opposing ridges 52, 54 which extend essentially the entire length of the phase shifter 32. Each of the ridges 52, 54 possesses a plurality of longitudinally spaced, threaded apertures which respectively receive inductive tuning elements in the form of screws 56, 58 that extend through the ridges and into the waveguide cavity. The tuning elements 56, 58 are spaced apart approximately a quarter wavelength at the center frequency and the reflection coefficient of the phase shifter 32 is set equal to optimal distributions in order to achieve best match. In the preferred embodiment, the total transmission phase shift is adjusted to be 90 degrees at the low frequency band. As best seen in FIG. 6, the depth of penetration of the tuning elements 56, 58 into the waveguide cavity is arranged so as to form a tapered configuration with the tuning elements 56, 58 near the center of the phase shifter 32 penetrating into the waveguide cavity to a greater degree than those near the ends.

The high pass filter 30 depicted in FIGS. 2, 3 and 5 possesses two identical halves **30*a*, 30*b* which are secured together in face-to-face relationship by any suitable means such as cap screws 47. The filter 30 includes flanges 49 at the ends thereof to provide a means for interconnecting the filter 30 with the reference waveguide 28 and phase shifter 32. The filter halves 30*a*, 30*b* collectively form an elongate waveguide body having an internal waveguide cavity. A pair of opposed, spaced apart ridges 44, 46 defined in the interior walls of the halves 30*a*, 30*b* extend essentially the entire length of the filter 30 and effectively provide a waveguide cavity which is H-shaped in cross-section. The sidewalls 48, 50 near the ends of the waveguide cavity are tapered or flared outwardly away from the ridges 44, 46. These outwardly flared sidewalls 48, 50 cooperate with the ridges 44, 46** to achieve a very low reflection loss in the passband and a very steep cut-off near the dividing frequency, i.e. the frequency between the upper and lower frequency bands. A study of the curve shape of the flared sidewalls has shown that using a special shape of exponential function raised to cosine square power results in a very steep cut-off. A shape in accordance with the following function has resulted in such a cut-off characteristic:

$$f(x) = c\epsilon^{\left(E\cos^2\left(\frac{\pi x}{2l}\right)\right)}$$

where:

f(x)=curve shape x=position along curve

2l=length of waveguide c,E=constants adjusted for sharp cut-off and desired match $\epsilon$=natural logarithm In the case of 8–18 GHz bandwidth, the transition frequency range near the dividing frequency is about 200 MHz, which is only 2 % of the total bandwidth and the return loss for the passband is on the order of −30 dB or better.

The reference waveguides 28, 38 are also identical in construction and, as shown in FIG. 2, each comprise elongate, rectangular waveguide bodies defining waveguide cavities which are rectangular in cross-section and equal in length to the phase shifters 32, 34.

The reference waveguides 28, 38 may also be ridged waveguide bodies defining waveguide cavities which are ridged in cross-section, such as double ridged, and equal in length to the phase shifters 32, 34.

The wideband, balanced diplexer described above is particularly well-suited for radar or communication use for applications where it is necessary to simultaneously operate in multiple frequency bands. The diplexer provides an exceptionally sharp cut-off property which in turn results in a larger useful frequency range with lower loss in the system.

Having thus described the invention, it is recognized that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A wideband diplexer having a sharp frequency cut-off for separating an incoming wideband microwave frequency signal into upper and lower frequency bands, comprising:

means for splitting said incoming signal into a first output signal having only said lower band of frequencies and into first and second intermediate signals each having both said upper and lower bands of frequencies and possessing essentially equal energy;

a pair of waveguide assembies for respectively removing the frequencies in said lower band from said first and second intermediate signals, each of said waveguide assemblies including:

(1) a first ridged waveguide tuned for shifting the phase of the lower frequency band, wherein said first ridged waveguide includes an elongate hollow waveguide body defining a waveguide cavity, said body having a pair of opposing ridges within said cavity, and a plurality of longitudinally spaced tuning elements extending through said ridges and into said cavity, (2) a second ridged waveguide for filtering out the lower frequency band; and means coupled with said waveguide assemblies for combining the filtered intermediate signals and having an output for delivering a second output signal having only said upper band of frequencies.

2. The wideband diplexer of claim 1, including means for adjusting the depth of penetration of said tuning elements into said cavity.

3. The widband diplexer of claim 1, wherein the depth of penetration of said tuning elements into said cavity is defined by a tapered distribution.

4. A wideband diplexer having a sharp frequency cut-off for separating an incoming wideband microwave frequency signal into upper and lower frequency bands, comprising:

means for splitting said incoming signal into a first output signal having only said lower band of frequencies and into first and second intermediate signals each having both said upper and lower bands of frequencies and possessing essentially equal energy;

a pair of waveguide assemblies for respectively removing the frequencies in said lower band from said first and second intermediate signals, each of said waveguide assemblies including:

(1) a first ridged waveguide having a cavity and being tuned for shifting the phase of the lower frequency band, wherein said waveguide cavity is generally H-shaped in cross-section, and further including a plurality of longitudinally spaced tuning elements extending into said H-shaped cavity;

(2) a second ridge waveguide for filtering out the lower frequency band; and means coupled with said waveguide assemblies for combining the filtered intermediate signals and having an output for delivering a second output signal having only said upper band of frequencies.

5. A wideband diplexer having a sharp frequency cut-off for separating an incoming wideband microwave frequency signal into upper and lower frequency bands, comprising:

means for splitting said incoming signal into a first output signal having only said lower band of frequencies and into first and second intermediate signals each having both said upper and lower bands of frequencies and possessing essentially equal energy;

a pair of waveguide assembies for respectively removing the frequencies in said lower band from said first and second intermediate signals, each of said waveguide assemblies including:

(1) a first ridged waveguide tuned for shifting the phase of the lower frequency band, (2) a second ridged waveguide for filtering out the lower frequency band wherein said second ridged waveguide includes an elongate, hollow waveguide body defining a waveguide cavity, said body has a pair of opposing ridges within said cavity, and said body includes opposed tapered sidewalls on each end thereof; and means coupled with said waveguide assemblies for combining the filtered intermediate signals and having an output for delivering a second output signal having only said upper band of frequencies.

6. The wideband diplexer of claim 5 wherein the tapered sidewalls comprise a shape in accordance with an exponential function raised to a cosine squared power.

7. The wideband diplexer of claim 6 wherein the exponential function comprises:

$$f(x) = c\epsilon\left(E\cos^2\left(\frac{\pi x}{2l}\right)\right)$$

8. A wideband diplexer having a sharp frequency cut-off for separating an incoming wideband microwave frequency signal into upper and lower frequency bands, comprising:

means for splitting said incoming signal into a first output signal having only said lower band of frequencies and into first and second intermediate signals each having both said upper and lower bands of frequencies and possessing essentially equal energy;

a pair of waveguide assembies for respectively removing the frequencies in said lower band from said first and second intermediate signals, each of said waveguide assemblies including:

(1) a first ridged waveguide tuned for shifting the phase of the lower frequency band, (2) a second ridged waveguide for filtering out the lower frequency band;

wherein each of said assemblies further includes a third waveguide for introducing a line delay and an associated insertion phase shift in the corresponding intermediate signal; and means coupled with said waveguide assemblies for combining the filtered intermediate signals and having an output for delivering a second output signal having only said upper band of frequencies.

9. The wideband diplexer of claim 8 wherein said third waveguide comprises a rectangular cross-section.

10. The wideband diplexer of claim 8 wherein said third waveguide comprises ridged waveguide.

11. The wideband diplexer of claim 10 wherein said ridged waveguide comprises double-ridged waveguide.

12. A device for splitting an incoming, wideband microwave frequency signal into first and second output signals respectively of upper and lower frequency bands, comprising:

first means for receiving said incoming signal and for dividing said incoming signal into an output signal having only said lower frequency band and into first and second intermediate signals, said first and second intermediate signals being of essentially equal energy and possessing frequencies in said upper and lower bands;

means for shifting the phase of said first intermediate signal, said phase shifting means including a ridged waveguide;

a pair of ridged waveguide filters for respectively receiving the phase shifted first intermediate signal and said second intermedite signal, said filters being operative to pass said upper frequency bands and to reflect said lower frequency bands with a sharp frequency cut-off therebetween, wherein each of said ridged waveguides includes an elongate, hollow waveguide body defining a waveguide cavity, the ridge in said waveguide being defined by a pair of opposed ridge portions extending into said cavity;

means coupled with one of said filters for balancing the phase shifting effect of said phase shifting means; and, means for combining the signals output by said filters to form said second output signal.

13. The device of claim 12, wherein each of said ridged waveguide filters includes a plurality of longitudinally spaced tuning elements extending through said ridge portions and into said cavity.

14. The device of claim 11, wherein each of said ridged waveguide filters includes a pair of opposed, tapered sidewalls at each end thereof.

15. The device of claim 14 wherein the tapered sidewalls comprise a shape in accordance with an exponential function raised to a cosine squared power.

16. The device of claim 15 wherein the exponential function comprises:

$$f(x) = c\epsilon\left(E\cos^2\left(\frac{\pi x}{2l}\right)\right)$$

17. The wideband diplexer of claim 12 wherein said means for balancing comprises a waveguide having a rectangular cross-section.

18. The wideband diplexer of claim 12 wherein said means for balancing comprises a ridged waveguide.

19. The wideband diplexer of claim 18 wherein said ridged waveguide comprises double-ridged waveguide.

20. A device for shifting the phase of a traveling electromagnetic wave, comprising:

an elongate, hollow waveguide body defining a waveguide cavity through which said electromagnetic wave may travel, said waveguide body having a pair of opposed, spaced apart ridges extending into said cavity and along essentially the entire length of said waveguide body; and, a plurality of tuning elements longitudinally spaced along said waveguide body and extending through said ridges into said cavity, said tuning elements being inductively coupled with said wave.

21. The device of claim 20, wherein said cavity is H-shaped in cross-section and further comprises a pair of opposed, tapered sidewalls at each end thereof, the taper of each sidewall comprising a shape in accordance with an exponential function raised to a cosine squared power.

22. The device of claim 21 wherein the exponential function comprises:

$$f(x) = c\epsilon\left(E\cos^2\left(\frac{\pi x}{2l}\right)\right)$$

23. A device for filtering preselected frequencies from a traveling electromagnetic wave, comprising:

an elongate, hollow waveguide body having opposing top and bottom walls and opposing side walls defining a waveguide cavity through which said electromagnetic wave may travel, said top and bottom walls being spaced apart from each other by substantially the same distance along their lengths.

said waveguide body having a pair of opposed spaced apart ridges attached to the top and bottom walls respectively and extending into said cavity along the entire length of said waveguide body, said side walls of said waveguide body being tapered outwardly to each end of said waveguide body.

24. The device of claim 23, wherein said opposing ridges are disposed between said tapered walls.

25. The device of claim 24 wherein the tapered sidewalls comprise a shape in accordance with an exponential function raised to a cosine squared power.

26. The device of claim 25 wherein the exponential function comprises:

$$f(x) = c\epsilon\left(E\cos^2\left(\frac{\pi x}{2l}\right)\right)$$

* * * * *